US011365468B2

(12) United States Patent
Pipard et al.

(10) Patent No.: US 11,365,468 B2
(45) Date of Patent: Jun. 21, 2022

(54) COLD ROLLED AND HEAT TREATED STEEL SHEET AND A METHOD OF MANUFACTURING THEREOF

(71) Applicant: ArcelorMittal, Luxembourg (LU)

(72) Inventors: Jean-Marc Pipard, Vaux (FR); Artem Arlazarov, Blenod les Pont a Mousson (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 16/761,086

(22) PCT Filed: Nov. 5, 2018

(86) PCT No.: PCT/IB2018/058665
§ 371 (c)(1),
(2) Date: May 1, 2020

(87) PCT Pub. No.: WO2019/092577
PCT Pub. Date: May 16, 2019

(65) Prior Publication Data

US 2020/0354823 A1 Nov. 12, 2020

(30) Foreign Application Priority Data

Nov. 10, 2017 (WO) ..... PCT/IB2017/057042

(51) Int. Cl.

| | |
|---|---|
| ***C22C 38/00*** | (2006.01) |
| ***C22C 38/58*** | (2006.01) |
| ***C21D 8/02*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/58* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/002* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 10,378,090 | B2 | 8/2019 | Kawano et al. | |
| 10,465,272 | B2 | 11/2019 | Wakabayashi et al. | |
| 2004/0234807 | A1 | 11/2004 | Suzuki et al. | |
| 2009/0053096 | A1 | 2/2009 | Miura et al. | |
| 2013/0330226 | A1 | 12/2013 | Murakami et al. | |
| 2015/0090377 | A1* | 4/2015 | Murakami | C22C 38/60 148/643 |
| 2016/0083819 | A1* | 3/2016 | Kawabe | C21D 9/46 148/518 |
| 2016/0122889 | A1 | 5/2016 | Muhr et al. | |
| 2016/0177414 | A1 | 6/2016 | Takashima et al. | |
| 2016/0369369 | A1 | 12/2016 | Takashima et al. | |
| 2017/0010695 | A1 | 4/2017 | Arlazarov et al. | |
| 2017/0101695 | A1 | 4/2017 | Arlazarov et al. | |
| 2017/0204491 | A1* | 7/2017 | Kawasaki | C21D 8/0278 |
| 2018/0202017 | A1 | 7/2018 | Drillet | |

FOREIGN PATENT DOCUMENTS

| | | |
|---|---|---|
| CN | 101928875 | 12/2010 |
| CN | 105940134 | 9/2016 |
| CN | 106604999 | 4/2017 |
| EP | 3009527 | 4/2016 |
| EP | 3128023 | 2/2017 |
| EP | 3144406 | 3/2017 |
| JP | 2008-297592 A | 12/2008 |

(Continued)

OTHER PUBLICATIONS

International Search Report of PCT/B2018/058665, dated Dec. 4, 2018.

John G. Lenard, 15—Flexible Rolling, Primer on Flat Rolling (Second Edition), Elsevier, 2014, pp. 337-348, ISBN 9780080994185, https://doi.org/10.1016/B978-0-08-099418-5.00015-9. (https://www.sciencedirect.com/science/article/pii/B9780080994185000159).

*Primary Examiner* — Seth Dumbris
*Assistant Examiner* — Kim S. Horger
(74) *Attorney, Agent, or Firm* — Davidson, Davidson & Kappel, LLC

(57) ABSTRACT

A cold rolled and heat treated steel sheet having a composition with the following elements, expressed in percentage by weight 0.10%≤Carbon≤0.5%, 1%≤Manganese≤3.4%, 0.5%≤Silicon≤2.5%, 0.03%≤Aluminum≤1.5%, Sulfur≤0.003%, 0.002%≤Phosphorus≤0.02%, Nitrogen≤0.01% and can contain one or more of the following optional elements 0.05%≤Chromium≤1%, 0.001%≤Molybdenum≤0.5%, 0.001%≤Niobium≤0.1%, 0.001%≤Titanium≤0.1%, 0.01%≤Copper≤2%, 0.01%≤Nickel≤3%, 0.0001%≤Calcium≤0.005%, Vanadium≤0.1%, Boron≤0.003%, Ceriums≤0.1%, Magnesiums≤0.010%, Zirconiums≤0.010% the remainder composition being composed of iron and the unavoidable impurities caused by processing, and a microstructure of the said rolled steel sheet having by area fraction, 10 to 30% Residual Austenite, 5 to 50% Annealed Bainite, 10 to 40% of Bainite, 1% to 20% Quenched Martensite, and less than 30% Tempered Martensite where the combined presence of Bainite and Residual Austenite shall be 30% or more.

21 Claims, No Drawings

(56) References Cited

FOREIGN PATENT DOCUMENTS

| | | | |
|---|---|---|---|
| JP | 2015-034327 | A | 2/2015 |
| JP | 2017-519107 | A | 7/2017 |
| KR | 20170002652 | | 1/2017 |
| KR | 101760224 | | 7/2017 |
| RU | 2586386 | C2 | 6/2016 |
| RU | 2599933 | C2 | 10/2016 |

* cited by examiner

COLD ROLLED AND HEAT TREATED STEEL SHEET AND A METHOD OF MANUFACTURING THEREOF

The present invention relates to cold rolled and heat treated steel sheet which is suitable for use as a steel sheets for automobiles.

BACKGROUND

Automotive parts are required to satisfy two inconsistent requirements, namely ease of forming and strength, but in recent years a third requirement of improvement in fuel consumption by reducing weight is also required in view of global environment concerns. Thus, now automotive parts must be made of material having high formability, in order to meet the criteria of ease of fit in the intricate automobile assembly, and at same time have to improve strength for vehicle crashworthiness and durability while reducing weight of vehicle to improve fuel efficiency.

Therefore, intense research and development endeavors have been undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for appreciation of the present invention:

EP3144406 discloses a high-strength cold-rolled steel sheet having excellent ductility that comprises by wt. %, Carbon (C): 0.1% to 0.3%, Silicon (Si): 0.1% to 2.0%, Aluminum (Al): 0.005% to 1.5%, Manganese (Mn): 1.5% to 3.0%, Phosphorus (P): 0.04% or less (excluding 0%), Sulfur (S): 0.015% or less (excluding 0%), Nitrogen (N): 0.02% or less (excluding 0%), and a remainder of Iron (Fe) and inevitable impurities wherein a sum of Silicon and Aluminum (Si+Al) (wt %) satisfies 1.0% or more, and wherein a microstructure comprises: by area fraction, 5% or less of polygonal ferrite having a minor axis to major axis ratio of 0.4 or greater, 70% or less (excluding 0%) of Acicular Ferrite having a minor axis to major axis ratio of 0.4 or less, 25% or less (excluding 0%) of acicular Retained Austenite, and a remainder of Martensite. Further EP3144406 envisages for a high strength steel with a tensile strength of 780 MPa or more.

EP3128023 mentions a high-strength cold-rolled steel sheet having excellent elongation, hole expandability, and delayed fracture resistance and high yield ratio, and a method for producing the steel sheet. A high-yield-ratio, high-strength cold-rolled steel sheet has a composition containing, in terms of % by mass, C: 0.13% to 0.25%, Si: 1.2% to 2.2%, Mn: 2.0% to 3.2%, P: 0.08% or less, S: 0.005% or less, Al: 0.01% to 0.08%, N: 0.008% or less, Ti: 0.055% to 0.130%, and the balance being Fe and unavoidable impurities. The steel sheet has a microstructure that contains 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and the bainite and the tempered martensite having an average crystal grain diameter of 5 μm or less.

EP3009527 provides a high-strength cold-rolled steel sheet having excellent elongation, excellent stretch flangeability, and high yield ratio and a method for manufacturing the same. The high-strength cold-rolled steel sheet has a composition and a microstructure. The composition contains 0.15% to 0.27% C, 0.8% to 2.4% Si, 2.3% to 3.5% Mn, 0.08% or less P, 0.005% or less S, 0.01% to 0.08% Al, and 0.010% or less N on a mass basis, the remainder being Fe and inevitable impurities. The microstructure comprises: ferrite having an average grain size of 5 μm or less and a volume fraction of 3% to 20%, retained austenite having a volume fraction of 5% to 20%, and martensite having a volume fraction of 5% to 20%, the remainder being bainite and/or tempered martensite. The total number of retained austenite with a grain size of 2 μm or less, martensite with a grain size of 2 μm or less, or a mixed phase thereof is 150 or more per 2,000 μm 2 of a thickness cross section parallel to the rolling direction of the steel sheet.

SUMMARY OF THE INVENTION

An object of the present invention is to solve these problems by making available cold-rolled heat treated steel sheets that simultaneously have:

- an ultimate tensile strength greater than or equal to 950 MPa and preferably above 980 MPa,
- a total elongation greater than or equal to 20% and preferably above 21%

The present invention provides a cold rolled and heat treated steel sheet having a composition comprising of the following elements, expressed in percentage by weight:

0.10%≤Carbon≤0.5%
1%≤Manganese≤3.4%
0.5%≤Silicon≤2.5%
0.03%≤Aluminum≤1.5%
Sulfur≤0.003%.
0.002%≤Phosphorus≤0.02%
Nitrogen≤0.01% and can contain one or more of the following optional elements 0.05%≤Chromium≤1%
0.001%≤Molybdenum≤0.5%
0.001%≤Niobium≤0.1%
0.001%≤Titanium·0.1%
0.01%≤Copper≤2%
0.01%≤Nickel≤3%
0.0001%≤Calcium≤0.005%
Vanadium≤0.1%
Boron≤0.003%
Cerium≤0.1%
Magnesium≤0.010%
Zirconium≤0.010% the remainder composition being composed of iron and the unavoidable impurities caused by processing, and a microstructure of the said rolled steel sheet comprises by area fraction, 10 to 30% Residual Austenite, 5 to 50% Annealed Bainite, 10 to 40% of Bainite, 1% to 20% Quenched Martensite, and less than 30% Tempered Martensite where the combined presence of Bainite and Residual Austenite shall be 30% or more.

In a preferred embodiment, the steel sheet according to the invention have yield strength/tensile strength ratio over 0.60 or greater.

In a preferred embodiment, the steel sheets according to the invention may also present yield strength equal to or greater than 600 MPa Preferably, such steel can also have a good suitability for forming, in particular for rolling with good weldability and coatability.

Another alternate or additional object of the present invention is to make available a method for the manufacturing of these sheets that is compatible with conventional industrial applications while being robust towards manufacturing parameters shifts.

The present invention thus provides a method of production of the cold rolled and heat treated steel sheet comprising the following steps:

providing the steel composition;

reheating said semi-finished product to a temperature between 1200° C. and 1280° C.;

rolling the said semi-finished product in the austenitic range wherein the hot rolling finishing temperature shall be above Ac3 to obtain a hot rolled steel sheet;

cooling the sheet at a cooling rate above 30° C./s to a coiling temperature which is below 600° C.; and coiling the said hot rolled sheet;

cooling the said hot rolled sheet to room temperature;

optionally performing scale removal step on said hot rolled steel sheet;

optionally annealing is performed on hot rolled steel sheet at temperature between 400° C. and 750° C.;

optionally performing scale removal step on said hot rolled steel sheet;

cold rolling the said hot rolled steel sheet with a reduction rate between 35 and 90% to obtain a cold rolled steel sheet;

then performing a first annealing by heating the said cold rolled steel sheet at a rate greater than 3° C./s to a soaking temperature between Ac3 and Ac3+100° C. where it is held during 10 seconds to 500 seconds;

then cooling the sheet at a rate greater than 25° C./s to a temperature between 380° C. and 480° C. and holding the cold rolled steel sheet for a time between 10 and 500 seconds;

cooling the cold-rolled steel sheet to the room temperature to obtain cold-rolled and annealed steel sheet;

then performing a second annealing by heating the said cold rolled and annealed steel sheet at a rate greater than 3° C./s to a soaking temperature between $T_{soaking}$ and Ac3 where it is held during 10 seconds to 500 seconds;

then cooling the sheet at a rate greater than 20° C./s to a temperature range between $Tc_{max}$ and $Tc_{min}$; wherein $Tc_{max}$ and $Tc_{min}$ are defined as follows:

$$Tc_{max}=565-601*(1-Exp(-0.868*C))-34*Mn-13*Si-10*Cr+13*Al-361*Nb$$

$$Tc_{min}=565-601*(1-Exp(-1.736*C))-34*Mn-13*Si-10*Cr+13*Al-361*Nb$$

wherein C, Mn, Si, Cr, Al and Nb are in wt. % of the elements in the steel then the said cold rolled and annealed steel sheet is brought to temperature range between 350° C. and 550° C. during 5 seconds and 500 seconds and the said annealed cold rolled steel sheet is cooled down to room temperature with a cooling rate higher than 1° C./s to obtain cold rolled and heat treated steel sheet.

The cold rolled heat treated steel sheet of the present invention may optionally be coated with zinc or zinc alloys, or with aluminum or aluminum alloys to improve its corrosion resistance.

DETAILED DESCRIPTION

Carbon is present in the steel between 0.10% and 0.5%. Carbon is an element necessary for increasing the strength of the steel of present invention by producing a low-temperature transformation phases such as Martensite, further Carbon also plays a pivotal role in Austenite stabilization, hence, it is a necessary element for securing Residual Austenite. Therefore, Carbon plays two pivotal roles, one is to increase the strength and another in retaining Austenite to impart ductility. But Carbon content less than 0.10% will not be able to stabilize Austenite in an adequate amount required by the steel of present invention. On the other hand, at a Carbon content exceeding 0.5%, the steel exhibits poor spot weldability, which limits its application for the automotive parts.

Manganese content of the steel of the present invention is between 1% and 3.4%. This element is gammagenous. The purpose of adding Manganese is essentially to obtain a structure that contains Austenite. Manganese is an element which stabilizes Austenite at room temperature to obtain Residual Austenite. An amount of at least about 1% by weight of Manganese is mandatory to provide the strength and hardenability to the steel of the present invention as well as to stabilize Austenite. Thus, a higher percentage of Manganese is preferred by the present invention such as up to 3.4%. But when Manganese content is more than 3.4% it produces adverse effects such as it retards transformation of Austenite to Bainite during the isothermal holding for Bainite transformation. In addition Manganese content of above 3.4% also deteriorates the weldability of the present steel as well as the ductility targets may not be achieved. The preferable range for Manganese is 1.2% and 2.3% and a more preferable range is between 1.2% and 2.2%.

Silicon content of the steel of the present invention is between 0.5% and 2.5%. Silicon is a constituent that can retard the precipitation of carbides during overageing, therefore, due to the presence of Silicon, Carbon rich Austenite is stabilized at room temperature. Further due to poor solubility of Silicon in carbide it effectively inhibits or retards the formation of carbides, hence, also promote the formation of low density carbides in Bainitic structure which is sought as per the present invention to impart the steel of present invention with its essential mechanical properties. However, disproportionate content of Silicon does not produce the mentioned effect and leads to problems such as temper embrittlement. Therefore, the concentration is controlled within an upper limit of 2.5%.

The content of the Aluminum is between 0.03% and 1.5%. In the present invention Aluminum removes Oxygen existing in molten steel to prevent Oxygen from forming a gas phase during solidification process. Aluminum also fixes Nitrogen in the steel to form Aluminum nitride so as to reduce the size of the grains. Higher content of Aluminum, above 1.5%, increases Ac3 point to a high temperature thereby lowering the productivity. Aluminum content between 1.0 and 1.5% can be used when high Manganese content is added in order to counterbalance the effect of Manganese on transformation points and Austenite formation evolution with temperature.

Chromium content of the steel of the present invention is between 0.05% and 1%. Chromium is an essential element that provide strength and hardening to the steel but when used above 1% impairs surface finish of steel. Further Chromium contents under 1% coarsen the dispersion pattern of carbide in Bainitic structures, hence, keep the density of Carbide low in Bainite.

Niobium is present in the steel of the present invention between 0.001% and 0.1% and suitable for forming carbonitrides to impart strength of the steel of present invention by precipitation hardening. Niobium will also impact the size of microstructural components through its precipitation as carbo-nitrides and by retarding the recrystallization during heating process. Thus a finer microstructure formed at the end of the holding temperature and as a consequence after the complete annealing will lead to the hardening of the product. However, Niobium content above 0.1% is not economically interesting as a saturation effect of its influence is observed and this means that additional amount of Niobium does not result in any strength improvement of the product.

Titanium is added to the steel of the present invention between 0.001% to 0.1% same as Niobium, it is involved in carbo-nitrides so plays a role in hardening. But it is also forms Titanium-nitrides appearing during solidification of the cast product. The amount of Titanium is so limited to 0.1% to avoid the formation of coarse Titanium-nitrides detrimental for formability. Titanium content below 0.001% does not impart any effect on the steel of the present invention.

Phosphorus constituent of the steel of the present invention is between 0.002% and 0.02%, Phosphorus reduces the spot weldability and the hot ductility, particularly due to its tendency to segregate at the grain boundaries or co-segregate with Manganese. For these reasons, its content is limited to 0.02% and preferably to lower than 0.013%.

Sulfur is not an essential element but may be contained as an impurity in steel and from point of view of the present invention the Sulfur content is preferably as low as possible, but is 0.003% or less from the viewpoint of manufacturing cost. Further if higher Sulfur is present in steel it combines to form Sulfides especially with Manganese and reduces its beneficial impact on the present invention.

Calcium content in the steel of present invention is between 0.001% and 0.005%. Calcium is added to the steel of present invention as an optional element especially during the inclusion treatment. Calcium contributes towards the refining of the steel by arresting the detrimental Sulfur content in globular form thereby retarding the harmful effect of Sulfur.

Nitrogen is limited to 0.01% in order to avoid ageing of material and to minimize the precipitation of Aluminum nitrides during solidification which are detrimental for mechanical properties of the steel.

Molybdenum is an optional element that constitutes 0% to 0.5% of the steel of the present invention; Molybdenum plays an effective role in improving hardenability and hardness, delays the appearance of Bainite and avoids carbides precipitation in Bainite. However, the addition of Molybdenum excessively increases the cost of the addition of alloy elements, so that for economic reasons its content is limited to 0.5%.

Copper may be added as an optional element in an amount of 0.01% to 2% to increase the strength of the steel and to improve its corrosion resistance. A minimum of 0.01% is required to get such effects. However, when its content is above 2%, it can degrade the surface aspects.

Nickel may be added as an optional element in an amount of 0.01% to 3% to increase the strength of the steel and to improve its toughness. A minimum of 0.01% is required to get such effects. However, when its content is above 3.0%, Nickel causes ductility deterioration.

Vanadium is effective in enhancing the strength of steel by forming carbides or carbo-nitrides and the upper limit is 0.1% from economic points of view. Other elements such as Cerium, Boron, Magnesium or Zirconium can be added individually or in combination in the following proportions: Cerium≤0.1%, Boron≤0.003%, Magnesium≤0.010% and Zirconium≤0.010%. Up to the maximum content levels indicated, these elements make it possible to refine the grain during solidification. The remainder of the composition of the steel consists of iron and inevitable impurities resulting from processing.

The microstructure of the sheet claimed by the invention consists of the following.

Bainite constitutes between 10% and 40% of microstructure by area fraction for the steel of the present invention. In the present invention the Bainite of the present invention cumulatively consists of Lath Bainite and Granular Bainite. To ensure a total elongation of 20% it is mandatory to have 10% of Bainite.

Residual Austenite constitutes 10% to 30% by area fraction of the steel. Residual Austenite is known to have a higher solubility of Carbon than Bainite and hence acts as effective Carbon trap therefore retarding the formation of carbides in Bainite. Carbon percentage inside the Residual Austenite of the present invention is preferably higher than 0.9%, and preferably lower than 1.1%. Residual Austenite of the steel according to the invention imparts an enhanced ductility.

Annealed Bainite constitutes 5% to 50% of the microstructure of the steel of the present invention by area fraction. Annealed Bainite imparts strength and formability to the steel of the present invention. Annealed Bainite is formed during the second annealing at a temperature between $T_{soaking}$ and Ac3. It is necessary to have 5% of Annealed Bainite to reach the targeted elongation by the steel of the present invention but when the amount of Annealed Bainite surpasses 50% the steel of the present invention is unable to reach the strength.

Quenched Martensite constitutes 1% to 20% of microstructure by area fraction. Quenched Martensite imparts strength to the present invention. Quenched Martensite is formed during the cooling of the second annealing. No minimum is required but when Quenched Martensite is in excess of 20% it imparts excess strength but deteriorates other mechanical properties beyond acceptable limit.

Tempered Martensite constitutes 0% to 30% of microstructure by area fraction. Martensite can be formed when steel is cooled between $Tc_{min}$ and $Tc_{max}$ and is tempered during the overaging holding. Tempered Martensite imparts ductility and strength to the present invention. When Tempered Martensite is in excess of 30%, it imparts excess strength but diminishes the elongation beyond acceptable limit.

In addition to the above-mentioned microstructure, the microstructure of the cold rolled and heat treated steel sheet is free from other microstructural components, such as pearlite, ferrite and cementite without impairing the mechanical properties of the steel sheets.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation and to ensure a ratio of local Carbon to nominal Carbon kept below 1.10. The slab provided by continuous casting process can be used directly at a high temperature after the continuous casting or may be first cooled to room temperature and then reheated for hot rolling.

The temperature of the slab which is subjected to hot rolling is preferably at least 1200° C. and must be below 1280° C. In case the temperature of the slab is lower than 1200° C., excessive load is imposed on a rolling mill, and further, the temperature of the steel may decrease to a Ferrite transformation temperature during finishing rolling, whereby the steel will be rolled in a state in which transformed Ferrite contained in the structure. Therefore, the temperature of the slab is preferably sufficiently high so that hot rolling can be completed in the temperature range of Ac3 to Ac3+100° C. and a final rolling temperature remains above Ac3. Reheating at temperatures above 1280° C. must be avoided because they are industrially expensive.

A final rolling temperature range between Ac3 to Ac3+100° C. is preferred to have a structure that is favorable to recrystallization and rolling. It is necessary to have final rolling pass to be performed at a temperature greater than Ac3, because below this temperature the steel sheet exhibits a significant drop in rollability. The sheet obtained in this manner is then cooled at a cooling rate above 30° C./s to the coiling temperature which must be below 600° C. Preferably, the cooling rate will be less than or equal to 200° C./s.

The hot rolled steel sheet is coiled at a coiling temperature below 600° C. to avoid the ovalization of the hot rolled steel sheet and preferably below 570° C. to avoid scale formation. The preferable range of coiling temperature is between 350 and 570° C. The coiled hot rolled steel sheet is cooled to room temperature before subjecting it to optional Hot band annealing.

The hot rolled steel sheet may be subjected to an optional scale removal step to remove the scale formed during the hot rolling. The hot rolled sheet may then subjected to optional Hot Band Annealing at temperatures between 400° C. and 750° C. for at least 12 hours and not more than 96 hours but the temperature shall be kept below 750° C. to avoid transforming partially the hot-rolled microstructure and, therefore, to losing the microstructure homogeneity. Thereafter, an optional scale removal step may be performed to remove the scale for example through pickling such steel sheet. This hot rolled steel sheet is cold rolled with a thickness reduction between 35 to 90%. The cold rolled steel sheet obtained from cold rolling process is then subjected to two steps of annealing to impart the steel of present invention with microstructure and mechanical properties.

In first annealing of the cold rolled steel sheet, the cold rolled steel sheet is heated at a heating rate which is greater than 3° C./s, to a soaking temperature between Ac3 and Ac3+100° C. wherein Ac3 for the present steel is calculated by using the following formula:

$$Ac3=901-262*C-29*Mn+31*Si-12*Cr-155*Nb+86*Al$$

wherein the elements contents are expressed in weight percentage.

The steel sheet is held at the soaking temperature during 10 seconds to 500 seconds to ensure a complete recrystallization and full transformation to Austenite of the strongly work hardened initial structure. The sheet is then cooled at a cooling rate greater than 25° C./s to a range between 380° C. and 480° C. and preferably to a range between 380 to 450° C. The cold rolled steel sheet is then held for 10 seconds to 500 seconds, and then the cold rolled steel sheet is cooled to room temperature to obtain annealed cold rolled steel sheet.

During a second annealing, the cold rolled and annealed steel sheet is heated at a heating rate which is greater than 3° C./s, to a soaking temperature between $T_{soaking}$ and Ac3 wherein $$T_{soaking}=830-260*C-25*Mn+22*Si+40*Al$$

wherein the elements contents are expressed in weight percentage during 10 seconds to 500 seconds to ensure an adequate re-crystallization and transformation to obtain a minimum of 50% Austenite microstructure. The sheet is then cooled at a cooling rate greater than 20° C./s to a temperature in the range between $Tc_{max}$ and $Tc_{min}$. These $Tc_{max}$ and $Tc_{min}$ are defined as follows:

$$Tc_{max}=565-601*(1-Exp(-0.868*C))-34*Mn-13*Si-10*Cr+13*Al-361*Nb$$

$$Tc_{min}=565-601*(1-Exp(-1.736*C))-34*Mn-13*Si-10*Cr+13*Al-361*Nb$$

wherein the elements content are expressed in weight percentage.

Thereafter, the cold rolled and annealed steel sheet is brought to a temperature range of 380 to 580° C. and kept during 10 seconds to 500 seconds to ensure the formation of an adequate amount of Bainite as well as to temper the Martensite to impart the steel of the present invention with targeted mechanical properties. Afterwards, the cold rolled and annealed steel sheet is cooled to room temperature with a cooling rate of at least 1° C./s to form Quenched Martensite to obtain a cold rolled and heat treated steel sheet.

The cold rolled heat treated steel sheet then may be optionally coated by any of the known industrial processes such as Electro-galvanization, JVD, PVD, Hot—dip(GI/GA) etc. The Electro-galvanization does not alter or modify any of the mechanical properties or microstructure of the cold rolled heat treated steel sheet as claimed. Electro-glavanization can be done by any conventional industrial process for instance by Electroplating.

The following tests, examples, figurative exemplification and tables which are presented herein are non-restricting in nature and must be considered for purposes of illustration only, and will display the advantageous features of the present invention.

Steel sheets made of steels with different compositions are enumerated and gathered in Table 1, where the steel sheets are produced according to process parameters as stipulated in Table 2, respectively. Thereafter Table 3 gathers the microstructure of the steel sheets obtained during the trials and Table 4 gathers the result of evaluations of obtained properties.

Table 1 depicts the steels with the compositions expressed in percentages by weight. The steel compositions 11 to 15 for the manufacture of sheets according to the invention, this table also specifies the reference steel compositions which are designated in table by R1 to R4. Table 1 also serves as comparison tabulation between the inventive steel and reference steel. Table 1 is herein

TABLE 1

| Steel Samples | C | Mn | Si | Al | S | P | N | Cr | Mo | Nb | Ti | Cu | Ni | Ca | V | B |
|---|---|---|---|---|---|---|---|---|---|---|---|---|---|---|---|---|
| I1 | 0.21 | 2.08 | 1.50 | 0.034 | 0.0010 | 0.010 | 0.0039 | 0.347 | 0.002 | 0.002 | 0.005 | 0.001 | 0.017 | 0.0007 | 0.002 | 0.0003 |
| I2 | 0.22 | 2.05 | 1.45 | 0.035 | 0.0010 | 0.012 | 0.0048 | 0.331 | 0.003 | 0.002 | 0.008 | 0.001 | 0.024 | 0.0006 | 0.003 | 0.0007 |
| I3 | 0.41 | 1.49 | 1.49 | 0.037 | 0.0016 | 0.009 | 0.0056 | 0.021 | 0.002 | 0.060 | 0.005 | 0.011 | 0.021 | 0.0007 | 0.001 | 0.0005 |
| I4 | 0.41 | 1.49 | 1.49 | 0.037 | 0.0016 | 0.009 | 0.0056 | 0.021 | 0.002 | 0.060 | 0.005 | 0.011 | 0.021 | 0.0007 | 0.001 | 0.0005 |
| I5 | 0.22 | 2.05 | 1.45 | 0.035 | 0.0010 | 0.012 | 0.0048 | 0.331 | 0.003 | 0.002 | 0.008 | 0.001 | 0.024 | 0.0006 | 0.003 | 0.0007 |
| R1 | 0.21 | 2.08 | 1.50 | 0.034 | 0.0010 | 0.010 | 0.0039 | 0.347 | 0.002 | 0.002 | 0.005 | 0.001 | 0.017 | 0.0007 | 0.002 | 0.0003 |
| R2 | 0.41 | 1.49 | 1.49 | 0.037 | 0.0016 | 0.009 | 0.0056 | 0.021 | 0.002 | 0.060 | 0.005 | 0.011 | 0.021 | 0.0007 | 0.001 | 0.0005 |
| R3 | 0.08 | 2.58 | 0.24 | 0.145 | 0.0020 | 0.009 | 0.0036 | 0.274 | 0.085 | 0.026 | 0.033 | 0.021 | 0.013 | 0.0004 | 0.001 | 0.0001 |
| R4 | 0.08 | 2.58 | 0.24 | 0.145 | 0.0020 | 0.009 | 0.0036 | 0.274 | 0.085 | 0.026 | 0.033 | 0.021 | 0.013 | 0.0004 | 0.001 | 0.0001 |

I = according to the invention; R = reference; underlined values: not according to the invention.

Table 2

Table 2 gathers the annealing process parameters implemented on the steels of Table 1. The Steel compositions 11 to 15 serving for the manufacture of sheets according to the invention, this table also specifies the reference steel which are designated in table by R1 to R4. Table 2 also shows a tabulation of $Tc_{min}$ and $Tc_{max}$. These $Tc_{max}$ and $Tc_{min}$ are defined for the inventive steels and reference steels as follows:

$$Tc_{max}=565-601*(1-\mathrm{Exp}(-0.868*C))-34*Mn-13*Si-10*Cr+13*Al-361*Nb$$

$$Tc_{min}=565-601*(1-\mathrm{Exp}(-1.736*C))-34*Mn-13*Si-10*Cr+13*Al-361*Nb$$

Further, before performing the annealing treatment on the steels of invention as well as on the reference ones, the steels were heated to a temperature between 1000° C. and 1280° C. and then subjected to hot rolling with finish temperature above 850° C. and thereafter were coiled at a temperature below 600° C. The Hot rolled coils were then processed as claimed and thereafter cold rolled with a thickness reduction between 30 to 95%. These cold rolled steel sheets of both inventive steel and reference steel were subjected to heat treatments as enumerated in Table 2 herein:

TABLE 2

| | | | | | First Annealing | | | | | |
|---|---|---|---|---|---|---|---|---|---|---|
| Steel Sample | Reheating T(° C.) | HR Finish T(° C.) | HR Coiling T(° C.) | CR reduction (%) | Heating rate for first annealing (° C./s) | Soaking T(° C.) | Soaking t (s) | Cooling rate after soaking of primary annealing (° C./s) | Holding temperature after T(° C.) | Holding t(s) |
| I1 | 1250 | 915 | 450 | 49 | 3.2 | 870 | 155 | 37 | 400 | 270 |
| I2 | 1243 | 926 | 451 | 48 | 10.7 | 880 | 328 | 35 | 405 | 373 |
| I3 | 1245 | 930 | 446 | 49 | 9.2 | 850 | 281 | 46 | 410 | 320 |
| I4 | 1245 | 930 | 446 | 49 | 9.2 | 850 | 281 | 46 | 410 | 320 |
| I5 | 1243 | 926 | 451 | 48 | 10.7 | 880 | 328 | 35 | 405 | 373 |
| R1 | 1250 | 915 | 450 | 49 | X | X | X | X | X | X |
| R2 | 1245 | 930 | 446 | 49 | 9.2 | 850 | 281 | 46 | 410 | 320 |
| R3 | 1239 | 913 | 550 | 51 | 6 | 850 | 120 | 70 | 400 | 200 |
| R4 | 1239 | 913 | 550 | 51 | X | X | X | X | X | X |

| | Second Annealing | | | | | | | | | | |
|---|---|---|---|---|---|---|---|---|---|---|---|
| Steel Sample | Heating rate for Finally annealing (° C./s) | soaking temperature T(° C.) | soaking time(s) | Cooling rate after soaking (° C./s) | Cooling temperature T(° C.) | Holding T(° C.) | Holding t (s) | Ac3 T(° C.) | $T_{soaking}$ T(° C.) | $Tc_{max}$ T(° C.) | Tcmin T(° C.) |
| I1 | 6 | 770 | 80 | 70 | 310 | 400 | 200 | 831 | 759 | 372 | 250 |
| I2 | 8.1 | 765 | 246 | 32 | 305 | 400 | 280 | 827 | 754 | 367 | 240 |
| I3 | 6 | 765 | 100 | 70 | 200 | 400 | 200 | 792 | 722 | 295 | 130 |
| I4 | 6 | 785 | 100 | 70 | 240 | 400 | 200 | 792 | 722 | 295 | 130 |
| I5 | 9.7 | 765 | 246 | 32 | 290 | 387 | 280 | 827 | 754 | 367 | 240 |
| R1 | 6 | 770 | 80 | 70 | 310 | 400 | 200 | 831 | 759 | 372 | 250 |
| R2 | 6 | 800 | 100 | 70 | 100 | 400 | 200 | 792 | 722 | 295 | 130 |
| R3 | 6 | 780 | 100 | 70 | 360 | 400 | 200 | 819 | 757 | 425 | 349 |
| R4 | 6 | 780 | 100 | 70 | 360 | 400 | 200 | 819 | 757 | 425 | 349 |

I = according to the invention; R = reference; underlined values: not according to the invention.

TABLE 3

| Steel Sample | Ferrite | Bainite | Residual Austenite | Tempered Martensite | Quenched Martensite | Annealed Bainite | Bainite + Residual Austenite |
|---|---|---|---|---|---|---|---|
| I1 | 0 | 18 | 17 | 5 | 13 | 47 | 35 |
| I2 | 0 | 30 | 16 | 2 | 11 | 41 | 46 |
| I3 | 0 | 37 | 19 | 13 | 3 | 28 | 56 |

TABLE 3-continued

| Steel Sample | Ferrite | Bainite | Residual Austenite | Tempered Martensite | Quenched Martensite | Annealed Bainite | Bainite + Residual Austenite |
|---|---|---|---|---|---|---|---|
| I4 | 0 | 39 | 23 | 16 | 13 | 9 | 62 |
| I5 | 0 | 19 | 20 | 11 | 7 | 43 | 49 |
| R1 | 45 | 15 | 10 | 9 | 21 | 0 | 25 |
| R2 | 0 | 2 | 5 | 83 | 1 | 9 | 7 |
| R3 | 0 | 25 | 6 | 12 | 11 | 46 | 31 |
| R4 | 43 | 17 | 4 | 22 | 14 | 0 | 21 |

I = according to the invention; R = reference; underlined values: not according to the invention.

Table 3 exemplifies the results of test conducted in accordance of standards on different microscopes such as Scanning Electron Microscope for determining microstructural composition of both the inventive steel and reference steel.

The results are stipulated herein:

TABLE 4

| Sample Steels | Tensile Strength (in MPa) | Yield Strength (in MPa) | YS/TS | Total Elongation (in %) |
|---|---|---|---|---|
| I1 | 981 | 615 | 0.63 | 27.3 |
| I2 | 1040 | 658 | 0.63 | 23.8 |
| I3 | 1071 | 795 | 0.74 | 27.8 |
| I4 | 980 | 686 | 0.70 | 29.6 |
| I5 | 1039 | 668 | 0.64 | 24.3 |
| R1 | 1098 | 502 | 0.46 | 15.5 |
| R2 | 1292 | 1076 | 0.83 | 13.8 |
| R3 | 914 | 565 | 0.62 | 14.4 |
| R4 | 1009 | 608 | 0.60 | 12.2 |

I = according to the invention; R = reference; underlined values: not according to the invention.

Table 4 exemplifies the mechanical properties of both the inventive steel and reference steel. In order to determine the tensile strength, yield strength and total elongation, tensile tests are conducted in accordance of JIS Z2241 standards.

Henceforth the outcome of the various mechanical tests conducted in accordance to the standards is tabulated:

What is claimed is:

1. A cold rolled and heat treated steel sheet having a composition comprising the following elements, expressed in percentage by weight:

0.10%≤Carbon≤0.5%
1%≤Manganese≤$^{3}$0.4%
0.5%≤Silicon≤2.5%
0.03%≤Aluminum≤1.5%
Sulfur≤0.003%.
0.002%≤Phosphorus≤0.02%
Nitrogen≤0.01%
and optionally one or more of the following elements:
0.05%≤Chromium≤1%
0.001%≤Molybdenum≤0.5%
0.001%≤Niobium≤0.1%
0.001%≤Titanium≤0.1%
0.01%≤Copper≤2%
0.01%≤Nickel≤3%
0.0001%≤Calcium≤0.005%
Vanadium≤0.1%
Boron≤0.003%
Cerium≤0.1%
Magnesium≤0.010%
Zirconium≤0.010% a remainder being iron and unavoidable impurities caused by processing;

a microstructure of the cold rolled and heat treated steel sheet comprising by area fraction, 10 to 30% Residual Austenite, 5 to 50% Annealed Bainite, 10 to 40% of Bainite, 1% to 20% Quenched Martensite, and less than 30% Tempered Martensite wherein the Bainite and the Residual Austenite are 30% or more.

2. The cold rolled and heat treated steel sheet as recited in claim 1 wherein the composition includes 0.7%≤Silicon≤2.2%.

3. The cold rolled and heat treated steel sheet as recited in claim 2 wherein the composition includes 1%≤Silicon≤2.2%.

4. The cold rolled and heat treated steel sheet as recited in claim 1 wherein the composition includes 0.03%≤Aluminum≤1.0%.

5. The cold rolled and heat treated steel sheet as recited in claim 1 wherein the composition includes 1.2%≤Manganese≤2.3%.

6. The cold rolled and heat treated steel sheet as recited in claim 1 wherein the composition includes 0.05%≤Chromium≤0.5%.

7. The cold rolled and heat treated steel sheet as recited in claim 1 wherein a sum of the Residual Austenite and the Bainite is greater than 35%.

8. The cold rolled and heat treated steel sheet as recited in claim 1 wherein a sum of the Annealed Bainite and the Bainite is greater than 45%.

9. The cold rolled and heat treated steel sheet as recited in claim 1 wherein the Residual Austenite is between 15 and 30%.

10. The cold rolled and heat treated steel sheet as recited in claim 1 wherein the Bainite is between 15% and 40%.

11. The cold rolled and heat treated steel sheet as recited in claim 1 wherein the cold rolled and heat treated steel sheet has a tensile strength greater than 950 MPa and total elongation of 20% or more.

12. The cold rolled and heat treated steel sheet as recited in claim 1 wherein the cold rolled and heat treated steel sheet has a yield strength above 600 MPa and a ratio of yield strength to tensile strength of 0.6 or more.

13. The cold rolled and heat treated steel sheet as recited in claim 1 wherein the cold rolled and heat treated steel sheet has a tensile strength between 1000 MPa and 1100 MPa and a total elongation of 23% or more.

14. The cold rolled and heat treated steel sheet as recited in claim 1 wherein the microstructure does not contain Ferrite.

15. A method of production of a cold rolled and heat treated steel sheet as recited in claim 1, the method comprising the following steps:

providing a steel with the composition to define a semi-finished product;

reheating the semi-finished product to a temperature between 1200° C. and 1280° C.;

rolling the semi-finished product in the austenitic range wherein the hot rolling finishing temperature is above Ac3 to obtain a hot rolled steel sheet;

cooling the hot rolled steel sheet at a cooling rate above 30° C./s to a coiling temperature below 600° C.; and coiling the hot rolled steel sheet;

cooling the hot rolled sheet to room temperature;

optionally performing a scale removal step on the hot rolled steel sheet;

optionally annealing the hot rolled steel sheet at a temperature between 400° C. and 750° C.;

cold rolling the hot rolled steel sheet with a reduction rate between 35 and 90% to obtain a cold rolled steel sheet;

then performing a first annealing by heating the cold rolled steel sheet at a rate greater than 3° C./s to a soaking temperature between Ac3 and Ac3+100° C. and holding the cold rolled sheet for a time of 10 seconds to 500 seconds;

then cooling the cold rolled sheet at a rate greater than 25° C./s to a temperature between 380° C. and 480° C. and holding the cold rolled steel sheet for a time of 10 and 500 seconds;

cooling the cold rolled steel sheet to room temperature to obtain a cold-rolled and annealed steel sheet;

then performing a second annealing by heating the cold rolled and annealed steel sheet at a rate greater than 3° C./s to a soaking temperature between $T_{soaking}$ and Ac3 and holding the cold rolled and annealed steel sheet for a time of 10 seconds to 500 seconds;

then cooling the cold rolled and annealed steel sheet at a rate greater than 20° C./s to a temperature range between $Tc_{max}$ and $Tc_{min}$; wherein $Tc_{max}$ and $Tc_{min}$ are defined as follows:

$$Tc_{max}=565-601*(1-\mathrm{Exp}(-0.868*C))-34*Mn-13*Si-10*Cr+13*Al-361*Nb$$

$$Tc_{min}=565-601*(1-\mathrm{Exp}(-1.736*C))-34*Mn-13*Si-10*Cr+13*Al-361*Nb$$

wherein C, Mn, Si, Cr, Al and Nb are in wt. % of the elements in the steel composition; and then bringing the cold rolled and annealed steel sheet to temperature range between 350° C. and 550° C. for a time of 5 seconds to 500 seconds and cooling the cold rolled and annealed steel sheet down to room temperature with a cooling rate higher than 1° C./s to obtain the cold rolled and heat treated steel sheet.

16. The method as recited in claim 13 wherein the coiling temperature is below 570° C.

17. The method as recited in claim 13 wherein the first annealing soaking temperature is between Ac3 and Ac3+75° C. for the 10 to 500 seconds.

18. The method as recited in claim 13 wherein the second annealing is a continuous annealing between $T_{soaking}$ and Ac3 for the 10 to 500 seconds to have an Austenite to Annealed Bainite ratio between 50:50 to 90:10.

19. A structural or safety part of a vehicle comprising the cold rolled and heat treated steel sheet as recited in claim 1.

20. The part as recited in claim 19 wherein the part is obtained by flexible rolling of the cold rolled and heat treated steel sheet.

21. A vehicle comprising the part as recited in claim 19.

* * * * *